United States Patent [19]

Fister, Jr.

[11] Patent Number: 4,668,011

[45] Date of Patent: May 26, 1987

[54] SEATING UNIT AND METHOD OF CONSTRUCTION

[76] Inventor: Lee H. Fister, Jr., P.O. Box 43, Centerville, Ohio 45459

[21] Appl. No.: 765,258

[22] Filed: Aug. 13, 1985

[51] Int. Cl.[4] ..... A47C 31/10

[52] U.S. Cl. ..... 297/218; 297/219; 297/226; 297/248

[58] Field of Search ..... 297/218, 219, 225, 226, 297/229, 441, 248

[56] References Cited

U.S. PATENT DOCUMENTS

| | | | |
|---|---|---|---|
| 659,251 | 10/1900 | Nevad | 297/218 |
| 780,166 | 1/1905 | Foster . | |
| 794,145 | 7/1905 | Ellington et al. | 297/219 |
| 1,384,908 | 7/1921 | Lodewood | 297/219 |
| 1,486,296 | 3/1924 | Olson | 297/219 |
| 1,645,120 | 10/1927 | Sterbenz | 297/218 |
| 2,086,640 | 7/1937 | Reynolds . | |
| 2,287,667 | 12/1940 | Brown . | |
| 2,383,687 | 8/1945 | Saltz | 297/226 X |
| 2,411,412 | 11/1946 | Blair et al. . | |
| 2,801,682 | 8/1957 | Fridolph . | |
| 2,811,199 | 10/1957 | Morrill et al. . | |
| 2,876,826 | 3/1959 | Neely et al. . | |
| 3,011,227 | 12/1961 | Vogel . | |
| 3,068,495 | 12/1962 | Quakenbush . | |
| 3,102,755 | 9/1963 | Wilfert . | |
| 3,103,082 | 9/1963 | Baermann . | |
| 3,162,484 | 12/1964 | Kleffman . | |
| 3,185,523 | 5/1965 | Morrill, Jr. . | |
| 3,216,029 | 11/1965 | Fritzmeier . | |
| 3,220,767 | 11/1965 | Hendrickson . | |
| 3,233,253 | 2/1966 | Cauvin . | |
| 3,256,038 | 6/1966 | Edelson et al. | 297/226 |
| 3,295,887 | 1/1967 | Bacon . | |
| 3,298,741 | 1/1967 | Lepard, Jr. et al. . | |
| 3,765,039 | 10/1973 | Ewoldt | 297/219 X |
| 3,774,966 | 11/1973 | Faulkner et al. | 297/218 X |
| 3,839,126 | 6/1958 | O'Neill . | |
| 3,928,898 | 12/1975 | Smoot . | |
| 3,944,281 | 3/1976 | Piretti | 297/248 X |
| 3,973,800 | 8/1976 | Kogan | 297/248 X |
| 3,981,534 | 9/1976 | Wilton . | |
| 3,988,034 | 10/1976 | Fister, Jr. . | |
| 4,077,666 | 5/1978 | Heumann . | |
| 4,232,899 | 11/1980 | Fister, Jr. . | |

FOREIGN PATENT DOCUMENTS

| | | |
|---|---|---|
| 820467 | 9/1959 | United Kingdom . |
| 894897 | 12/1960 | United Kingdom . |

*Primary Examiner*—Peter A. Aschenbrenner
*Assistant Examiner*—Peter R. Brown
*Attorney, Agent, or Firm*—Wood, Herron & Evans

[57] ABSTRACT

The invention herein disclosed relates to an improved method of upholstering seating units having rigid frames. After the rigid frame is constructed and various surfaces including its seat and back portions covered with a resilient foam layer, an upholstery cover 26 is positioned over the frame and secured thereto through the use of rigid bars 34 carried in casings 32 that extend around the perimeter of the bottom of the cover 26. The bars 34 have adjustment holes 36 which engage studs 16 on the frame. Wing nuts 38 secure the bars 34 to the studs 16.

9 Claims, 3 Drawing Figures

SEATING UNIT AND METHOD OF CONSTRUCTION

BACKGROUND OF THE INVENTION

This invention relates to upholstered seating units having one-piece removable seat covers and to the seating unit produced thereby. More particularly, the present invention is primarily directed to contemporary seating units, although it has application as well to more traditional seating units.

Contemporary seating units are generally of two types of construction. One is the all foam type construction. One form of such construction is disclosed in my U.S. Pat. No. 3,988,034. The other type of construction utilizes an internal rigid frame as shown in my U.S. Pat. No. 4,232,899. This invention is especially adapted for the latter type construction but could be adapted for use with the former. While the invention of my U.S. Pat. No. 4,232,899 has been widely used and accepted, there remains a need to provide a means to achieve adjustability so that variations in the upholstery cover's size due to wear or cleaning, etc. can be accommodated, and to do so in an economical manner.

More particularly, it has been an important object of the present invention to provide a contemporary seating unit where a rigid frame can be quickly and easily upholstered and where that upholstery can be quickly and easily replaced by the user when it has become worn, soiled or otherwise unserviceable.

It has been another object of this invention to provide such a chair whereby uniform tension may be applied to the upholstery material so that aesthetically pleasing contours are obtained. It is a further important objective to provide such a method whereby a neat, clean and unwrinkled upholstery surface is provided and is maintained even after a substantial amount of usage. It is still a further objective to provide an easy means to adjust the fit of the upholstery cover so that if the fabric stretches or shrinks during usage the cover can be easily loosened or tightened to accommodate the change and to provide a proper fit.

SUMMARY OF THE INVENTION

The present invention is directed, in the preferred embodiment, to a chair having a rigid frame and a resilient material overlying said frame in the occupant seating area. A one-piece removable upholstery cover having an open bottom portion is adapted to slide over and cover the frame and resilient material. Fabric casings are sewn into the perimeter of the bottom sides of the upholstery cover that define the open bottom portion. Rigid bars having holes therein are inserted in the fabric casing. The holes receive studs inserted into the frame of the chair so as to position the cover with respect to the frame. When so installed, the bars are secured by wing nuts that engage the studs. A plurality of holes in the bars, vertically spaced apart, provide a means for adjusting the fit of the upholstery cover. A plurality of removable plates overlie and apply tension to the upholstery and bars when the rigid bars are secured to the frame. Removable arms may be employed. U-shaped clip means are provided to join two or more chairs together to form a seating unit.

The contemporary seating units of the present invention are characterized by their unemcumbered appearance and by their clean, unbroken, smooth lines. The construction of the seating units facilitates their upholstering and also quite significantly increases the ease with which the unit may be reupholstered or the old cover removed, cleaned and reinstalled. This is an especially important feature of my invention since the contemporary seating units of the present invention are especially adapted for use in public areas where the units are subjected to substantial usage. Under such conditions the covers must be frequently replaced or cleaned. The former has not in many instances been a viable alternative with most prior art chairs because the units have to be withdrawn from service for sometimes relatively lengthy periods of service so that skilled workers can reupholster them.

A still further advantage of this invention is the provision of a means to accommodate variations in upholstery cover size. For example, after use the cover may stretch slightly, or, after cleaning the size may shrink from the original dimensions. The present invention provides a means to easily adjust the fit of the cover so that the originally obtained fit can still be achieved. By simply removing the wing nuts that secure the bars to the frame and using a different hole in the bar the fit can be adjusted.

The present invention provides a method whereby a person may quickly and easily reupholster a seating unit without any prior training. Cutting or sewing of fabric, stapling, gluing or other conventional upholstery techniques are not required in order to install the upholstery material on the seating frame. On-site replacement can be easily accomplished.

Another important advantage of this invention is the uniformity and reproducibility of the method. Such insures that the seating unit may be reupholstered without attendant unexpected difficulties.

DESCRIPTION OF THE DRAWINGS

FIG. 1 is an exploded view of two of the chairs of the present invention with an arm in between;

FIG. 2 is an exploded view showing the bar in the upholstery casing and the adjustment holes.

DESCRIPTION OF THE PREFERRED EMBODIMENT

Figures 1, 2:
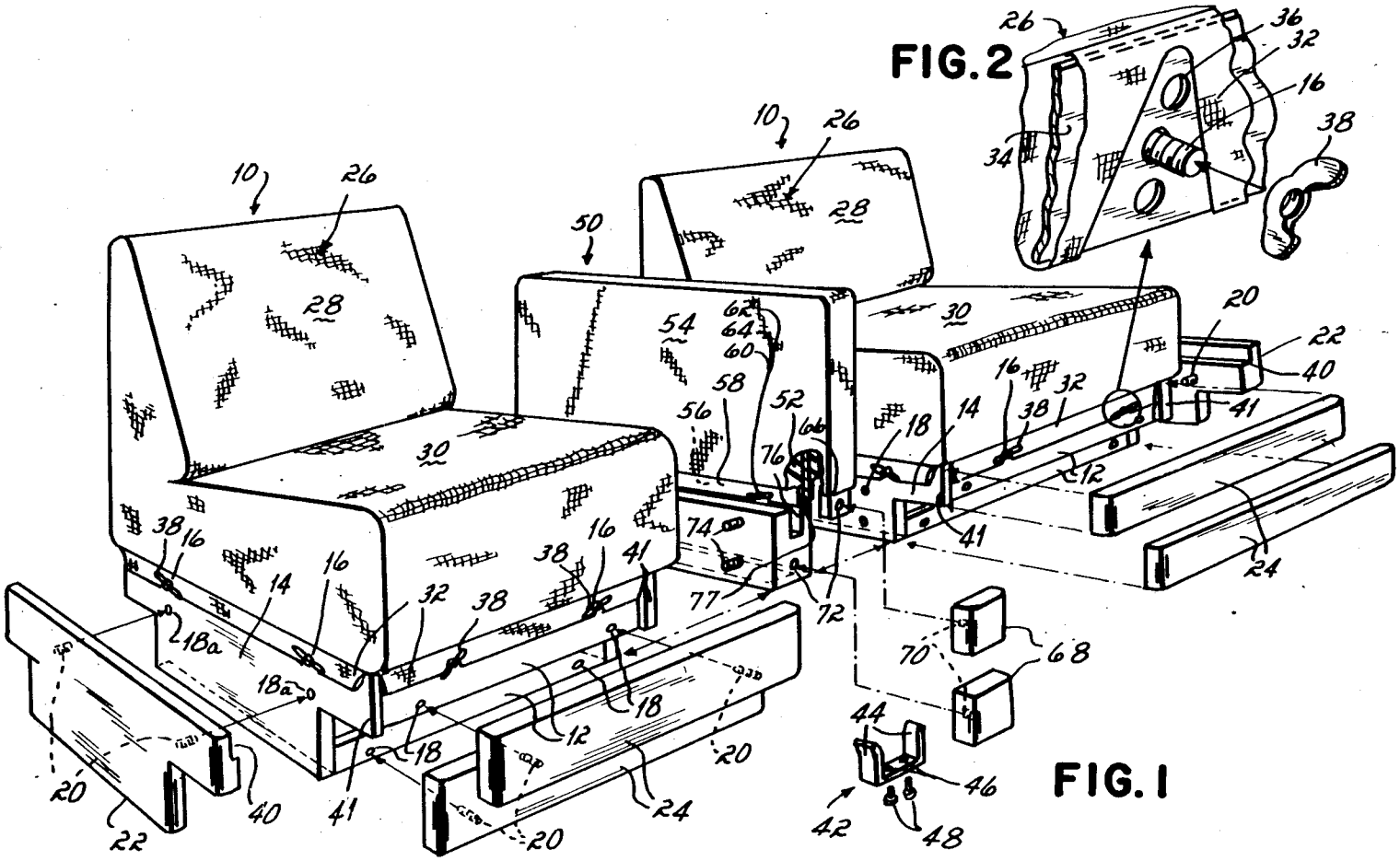

Referring to FIG. 1, the novel chair 10 of the present invention will now be described. The bottom of the chair frame is rigid and comprises a base formed by two front members 12, and two side members 14. The bottom of the chair is of rectangular shape. The rigid chair also includes a back portion frame, not shown, and is of conventional design such as shown in my U.S. Pat. No. 4,232,899, incorporated by reference herein. While a rigid frame is comtemplated, which defines a seat and back portion, the present invention could be adapted for use with an all foam seating unit, with a wood base. That is, by providing the all foam chair that is disclosed in my U.S. Pat. No. 3,988,034 incorporated by reference herein, with a wooden base, the present upholstery cover and attachment means could be used. In one form the side members 14 are generally speaking parallel to one another as are the front members 12 and the back member. Alternatively the side members 14 need not be parallel if one wishes to provide seating units that may be joined together to provide a curvilinear grouping. The front members 12, side members 14, and back members are secured together by conventional means, not shown. A resilient material, as for example foam rubber, is secured, preferably by adhesive, to boards or webbing, not shown, that are attached to the frame to form a seat and back portion. The boards or webbing form a generally vertical back and a generally horizontal seat portion.

Inserted into the front members 12, side members 14 and the back member, that form the chair frame bottom are studs 16. Preferably, the studs 16 are threaded into the members 12, 14 and the back member. The front 12 and side 14 members also include a plurality of holes 18 which will cooperate with studs 20 on side plates 22, face plates 24 and back plates, not shown in a manner described below.

A one-piece upholstery cover 26 is constructed like the one shown in my U.S. Pat. No. 4,232,899, that is, it has a back portion 28 and a seat portion 30. When the cover 26 is installed the back and seat portions, 28 and 30, will define the occupant seating area. Around the bottom perimeter of the cover 26 the fabric is doubled over and sewn so as to form casings 32 like those shown in my U.S. Pat. No. 4,232,899. Inserted into each casing 32 is a rectangular shaped rigid metal bar 34 which is best seen in FIG. 2. The bar includes a plurality of adjustment holes 36. Preferably, three holes 36 are vertically spaced apart so as to provide a means for tensioning and adjusting the cover 26 in a manner described below. While preferably a group of three adjustment holes are provided towards the end of each bar 34, different numbers and positions could be selected. As shown in FIG. 2, a portion of each fabric casing 32 is cut away so that the adjustment holes 36 are exposed. The bars 34 may be inserted and withdrawn from the casings 32 so that after removal the cover 26 can be dry cleaned. The cover is constructed so that when it is originally installed, the center hole 36 is used. If during use the fabric stretches to cover may be tightened by using the top hole 36. If the fabric shrinks, as for example after cleaning, loosen the fit by using the bottom hole.

Assembly of the chair 10 is extremely easy and can be accomplished quickly, without the need for any tool. For example, assuming one has the cover 26 removed, all one does is to position the cover 26 over the frame, pull it downwardly until the rigid bars 34 are pulled down to a position adjacent to the studs 16, and then secure the bars to the frame 34 by placing the studs 16 through the adjustment holes 36. Wing nuts 38 are then threaded onto the studs 16 to secure the bar 34 to the frame. The adjustment hole 36 in the vertical group of three is selected which best achieves a proper fit. Through the provision of three such holes any slack in the cover 26 may be compensated for, if required, as for example after removal and cleaning.

Cooperating with the bars 34 to hold the cover 26 in place on the frame, and to also cover the studs 16, wing nuts 38, and bars 34, are side plate 22, and face plates 24. It should be noted that the side plates 22 have inside recessed portions 40 that are adapted to insure that the wing nuts 38 do not hinder the assembly of the plates 22. A spacer 41 at the frong of each side member 14 insures that face plates 24 do not interfere with the wing nuts 38. Studs 20 in the plates 22 and 24 pass through the holes 18 and wing nuts, not shown, hold the plates 22 and 24 to the side members 14, front member 12, and the back member, not shown.

Figure 3:
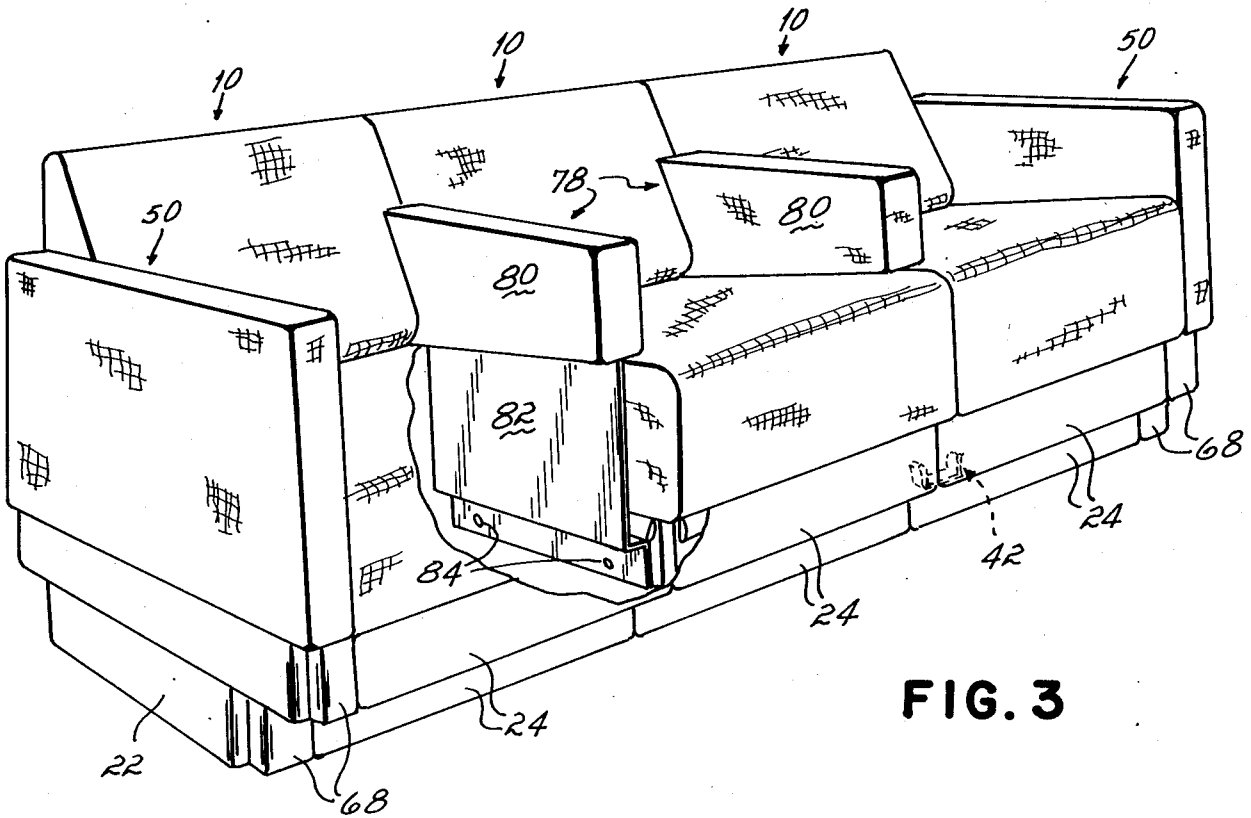
FIG. 3 shows several chairs joined together.

Referring to FIGS. 1 and 3, a novel U-shaped metal ganging clip 42 is shown. The distance between the vertical posts 44 is slightly less than double the thickness of the side members 14 so that one post 44 will be on the inside of one side member 14 of one chair and the other post 44 will be on the inside of the side member 14 of an adjacent chair. Preferably the posts 44 are slightly tapered toward each other so as to create a spring effect when the clip 42 engages each side member 14. The clip 42 has two holes 46 therein so that bolts 48 can be inserted therethrough. The bolts engage nuts, not shown, inserted in the bottom of the side members 14. While bolts 48 are employed, they are not absolute requirements. As shown in FIG. 3, the ganging clip 42 engages adjacent side members 14 at a forward position which extends beyond the bottom of the chair.

Referring to FIG. 1, there is illustrated a chair arm 50 adapted to be positioned and secured between two chairs 10 when they are joined together by a ganging clip 42. The arm 50 may also be used as an end arm. The arm 50 is made from wood and is padded with a resilient foam material 52. It is covered with a one-piece arm cover 54. The cover 54 is secured to the arm 50 through the use of two rigid bars 56, one on each side of the arm 50, that are enclosed in fabric casings 58, and which have adjustment holes 60 that engage threaded studs 62 inserted into nuts, not shown, inserted in the arm 50. Wing nuts 64 secure the bars 56 to the studs 62. This means of securing the cover 54 to the arm 50 is identical to the means described for securing the one-piece upholstery cover 26 to the chair frame. A plurality of adjustment holes 60 may be used, vertically spaced apart, to provide a means for adjusting the fit of the arm cover 54. At the front and rear of the arm, at the bottom, a Velcro fastener 66 may be used to secure that portion of the cover 54 to the arm 50. Finished end caps 68 with studs 70 provides a convenient means for covering the exterior bottom portions of the chair arm 50. Wing nuts, not shown, engage the studs 70 after the studs 70 are inserted through holes 72.

The arm 50 is secured to a side member 14 through the use of bolts 74 that pass through the arm 50 and which pass through holes 18 in the side member 14. Wing nuts, not shown, are then threaded onto the bolts 74. The slot 76 in the arm 50 provides access to the ends of the bolts 74. Bolts 74 are only used on one side of the arm 50. A slot 77 formed by the construction of an arm 50 is designed to receive a ganging clip 42.

When used as an end arm, as for example as shown in FIG. 3, a side plate 22 covers the bottom of the arm 50.

There is shown in FIG. 3 an alternative arm structure 78 that can be used when two chairs 10 are joined together. The arm includes an upholstered padded upper part 80 on a sheet metal lower part 82 that has holes 84 at the bottom through which bolts, not shown, can pass through. The bolts also would pass through holes in the side member 14 and wing nuts, not shown, would then secure the arm 78 to the chair 10.

What is claimed is:

1. A chair comprising, a rigid frame comprising a base having side members, a front member and a rear member, said frame forming a seat and back area, a resilient material overlying said frame, including said seat and back area, a one-piece upholstery cover having a seat and back portion and an open bottom portion, fabric casings sewn around the open bottom portion of said cover, rigid bars in said fabric casings and removable therefrom, a plurality of studs in the side, front and back members, a plurality of groups of adjustment holes in each bar, said holes spaced perpendicularly from the longitudinal axis of said bar and engageable with said studs for adjusting the tension of said cover relative to the rigid frame, means to hold said bars to said studs, and a plurality of removable plates overlying a plurality of said bars when said bars engage said studs.

2. The chair of claim 1 wherein each group of adjustment holes contains three adjustment holes in alignment.

3. The chair of claim 2 wherein the bars are rectangular in cross-section.

4. The chair of claim 2 wherein the bars are removable from said casings.

5. The chair of claim 1 wherein at least one arm is removably attached to the frame.

6. A seating unit comprising a plurality of chairs of claim 4 removably secured together by U-shaped ganging clips that engage a side of one chair and the adjoining side or arm of an adjacent chair.

7. The seating unit of claim 5 having fastening means securing said U-shaped ganging clips to the side of one chair and the side or arm of the adjoining chair.

8. The seating unit of claim 6 wherein the bars are rectangular in cross-section and are removable from said casings.

9. The seating unit of claim 2 or 8 wherein the means to hold said bars to said studs are wing nuts.

* * * * *